US009339820B2

(12) United States Patent
Lindberg et al.

(10) Patent No.: US 9,339,820 B2
(45) Date of Patent: May 17, 2016

(54) JAW CRUSHER SUPPORT FRAME

(71) Applicant: SANDVIK INTELLECTUAL PROPERTY AB, Sandviken (SE)

(72) Inventors: Marten Lindberg, Malmo (SE); Karin Ljunggren, Limhamm (SE); Roger Sjobeck, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/399,430

(22) PCT Filed: Apr. 29, 2013

(86) PCT No.: PCT/EP2013/058830
§ 371 (c)(1),
(2) Date: Nov. 6, 2014

(87) PCT Pub. No.: WO2013/167402
PCT Pub. Date: Nov. 14, 2013

(65) Prior Publication Data

US 2015/0097064 A1 Apr. 9, 2015

(30) Foreign Application Priority Data

May 7, 2012 (EP) ..... 12166954

(51) Int. Cl.
*B02C 1/02* (2006.01)

(52) U.S. Cl.
CPC .. *B02C 1/02* (2013.01); *B02C 1/025* (2013.01)

(58) Field of Classification Search
CPC ..... B02C 1/10; B02C 1/04; B02C 1/02; B02C 1/005; B02C 1/00; B02C 1/043; B02C 1/08
USPC ..... 241/101.73, 264, 265, 266, 245, 241/267–269
See application file for complete search history.

(56) References Cited

U.S. PATENT DOCUMENTS

| | | | | |
|---|---|---|---|---|
| 2,532,678 | A * | 12/1950 | Shelton | B02C 1/025 241/217 |
| 2,605,051 | A | 7/1952 | Bogie | |
| 5,769,334 | A | 6/1998 | Nakayama et al. | |
| 5,799,888 | A | 9/1998 | Hamaguchi et al. | |
| 6,375,105 | B1 * | 4/2002 | Haven | B02C 1/025 241/264 |

FOREIGN PATENT DOCUMENTS

| | | | | |
|---|---|---|---|---|
| EP | 0773067 | A1 * | 5/1997 | B02C 1/025 |
| FR | 2683462 | A1 | 5/1993 | |
| JP | 2007185566 | A | 7/2007 | |
| JP | 2009297591 | A | 12/2009 | |
| WO | 97/36683 | A1 | 10/1997 | |
| WO | 02/34393 | A1 | 5/2002 | |
| WO | 2008010072 | A2 | 1/2008 | |

* cited by examiner

*Primary Examiner* — Shelley Self
*Assistant Examiner* — Peter Iannuzzi
(74) *Attorney, Agent, or Firm* — Corinne R. Gorski

(57) ABSTRACT

A jaw crusher movable jaw support frame mounts a linkage assembly for suspending a movable jaw in a floating relationship within a jaw crusher relative to a stationary jaw. The support frame includes reinforcement regions extending along a main force transmission wall to absorb and transmit loading forces imparted to the support frame from the movable jaw.

14 Claims, 4 Drawing Sheets

A - A

JAW CRUSHER SUPPORT FRAME

RELATED APPLICATION DATA

This application is a §371 National Stage Application of PCT International Application No. PCT/EP2013/058830 filed Apr. 29, 2013 claiming priority of EP Application No. 12166954.3, filed May 7, 2012.

FIELD OF INVENTION

The present invention relates to a jaw crusher and in particular, although not exclusively, to a jaw support frame configured to support a movable jaw of the jaw crusher via a mechanically actuated link assembly.

BACKGROUND ART

Jaw crusher units typically comprise a fixed jaw and a movable jaw that define a crushing zone therebetween and a drive mechanism operative to rock the movable jaw back and forth in order to crush material in the crushing zone.

The crushing zone defined between the fixed jaw and the movable jaw is generally convergent towards its lower discharge end so that crushable material fed to the upper and wider end of the zone is then capable of falling downward under gravity whilst being subject to repeated cycles of crushing movement in response to the cyclical motion of the movable jaw. The crushed material is then discharged under gravity through the narrower lower discharge end onto a conveyor belt for onward processing or final discharge from the crusher unit to a suitable stock pile.

Commonly, the frame that supports the fixed and movable jaws is referred to as the front frame end. The front frame end of the movable jaw is connected to what is typically referred to as a back frame end via a mechanically actuated link mechanism that serves to control and stabilise the oscillating movement of the movable jaw relative to the stationary jaw. Typically, the link mechanism is both statically and dynamically linearly adjustable to control the grade or size of the resultant crushed material, to facilitate absorption of the impact forces generated by the crushing action and to expand or open the crushing zone to prevent damage to the crusher in the event of non-crushable material being accidentally introduced into the crushing zone.

Example jaw crushers comprising linkage assemblies connecting the back frame and front frame ends are described in FR 2683462; EP 0773067; WO 97/36683; U.S. Pat. No. 5,799,888; WO 02/34393; WO 2008/010072 and JP 2009-297591.

The assembly and construction of jaw crushers particularly at the back frame and front frame regions is a compromise between strength and weight. On the one hand the crusher must be sufficiently robust with various components having the required stiffness to withstand the significant loading forces created and transmitted to the jaw crusher. On the other hand, manufacture, transportation and use of very heavy crushers is undesirable.

There is therefore a requirement for a jaw crusher and in particular a jaw crusher support frame that addresses the above problems.

SUMMARY OF THE INVENTION

Accordingly, one objective of the present invention is to provide a jaw crusher support frame that provides optimisation of strength and weight. The objective is achieved via a shape profile of the back frame end that increases the loading force capacity over conventional frame designs without increasing the weight of the crusher. Additionally, the present support frame enables the crusher to operate via two different setting functions having different load capacities and action within the same crusher unit.

The objective is achieved, in particular, via a shape profile of a force transmission wall of the back frame end that is optimised to discharge the loading forces imparted to the back frame end from the front frame end of the movable jaw, into the side walls of the main frame of the crusher. Advantageously, due to the present configuration of the force transmission wall at the back frame end, a crusher according to the subject invention is capable of a higher capacity over conventional crusher configurations with regard to loading forces. Importantly, the present back frame end and jaw crusher unit has no net weight increase over conventional designs so as to provide an optimised strength to weight ratio.

A further advantage with the subject invention is the dual function provided, in part, by the design of the force transmission wall at the back frame end. The present crusher is capable of operating in a 'shims' or 'cylinder' mode within the same unit. This is achieved as the force transmission wall at the back frame end allows passage of a piston as part of a mechanical actuator and thrust-bearing cylinder arrangement to control the position of a movable jaw via a link member (i.e., toggle plate) coupled to the movable jaw. Additionally, shim projections at the force transmission wall provide abutment regions for operation in a second, higher load capacity mode with the piston and cylinder isolated.

According to a first aspect of present invention there is provided a jaw crusher support frame to support a movable jaw of a jaw crusher via a mechanically actuated link assembly connected to the movable jaw, at least a part of the link assembly configured to allow the movable jaw to oscillate relative to a substantially stationary jaw in order to crush material in a zone between the movable and stationary jaws, the support frame comprising: a force transmission wall to extend generally in a plane transverse or perpendicular to a longitudinal axis of the link assembly, the wall having a first side to be facing the movable jaw and a second side to be rear facing away from the movable jaw; the support frame characterised by: a piston aperture in the wall to allow a piston to extend from the first side of the wall, the piston connected to a mechanical actuator positioned at a region of the second side of the wall; and first and second reinforcement end regions extending along respective first and second lengthwise ends of the wall, each end region comprising a first and a second flange, the first flange projecting forward from the first side of the wall to extend towards the movable jaw and the second flange projecting from the second side of the wall to extend away from the movable jaw.

Preferably, the first and second flanges are curved relative to a plane of the force transmission wall such that the first and the second flanges curve back towards the plane of the force transmission wall.

Preferably, the first and the second flanges each define a respective recessed gully extending lengthwise along the force transmission wall at each lengthwise end.

Optionally, a radius of curvature of one of the first flanges at one lengthwise end of the force transmission wall is less than a radius of curvature of the second flange at said lengthwise end. Optionally, an end region of the first flange is aligned substantially parallel to the force transmission wall and projects forward of the first side of the force transmission wall.

Preferably, the support frame further comprises side walls extending substantially perpendicular to the force transmission wall, the side walls projecting from widthwise edges of the force transmission wall in a direction from the first side of the force transmission wall.

Preferably, a region around the aperture comprises a reinforcement collar projecting from the first side of the force transmission wall to reinforce the region of the aperture against loading forces imparted to the force transmission wall.

Optionally, the end region of the first flange projects forward of the force transmission wall by a substantially equal distance by which the reinforcement collar projects from the first side of the force transmission wall. Preferably, each side wall comprises an aperture.

Preferably, the support frame further comprises at least one shim projection extending from the first side of the force transmission wall. Preferably, the support frame comprises two shim projections positioned substantially at a mid region of the force transmission wall between the first and second reinforcement ends. Preferably, the two shim projections are positioned at the side of each respective aperture between the aperture and each respective side wall. Preferably, the shim projections further extend from the second side of the force transmission wall.

Preferably, the side walls also project from the second side of the force transmission wall.

According to a second aspect of present invention there is provided a jaw crusher comprising: a movable jaw and a substantially stationary jaw mounted in opposed relationship to define a crushing zone between the jaws; a drive mechanism coupled with the movable jaw and operative to oscillate the movable jaw relative to the stationary jaw in order to crush material in the crushing zone; a mechanical actuator link assembly connected to the movable jaw and configured to control a separation distance of the movable jaw from the stationary jaw; and a support frame as claimed in any preceding claim to support the movable jaw via the link assembly.

BRIEF DESCRIPTION OF DRAWINGS

A specific embodiment of the subject invention will now be described, by way of example only, and with reference to the accompanying drawings in which.

DETAILED DESCRIPTION OF PREFERRED EMBODIMENT OF THE INVENTION

Figure 1:
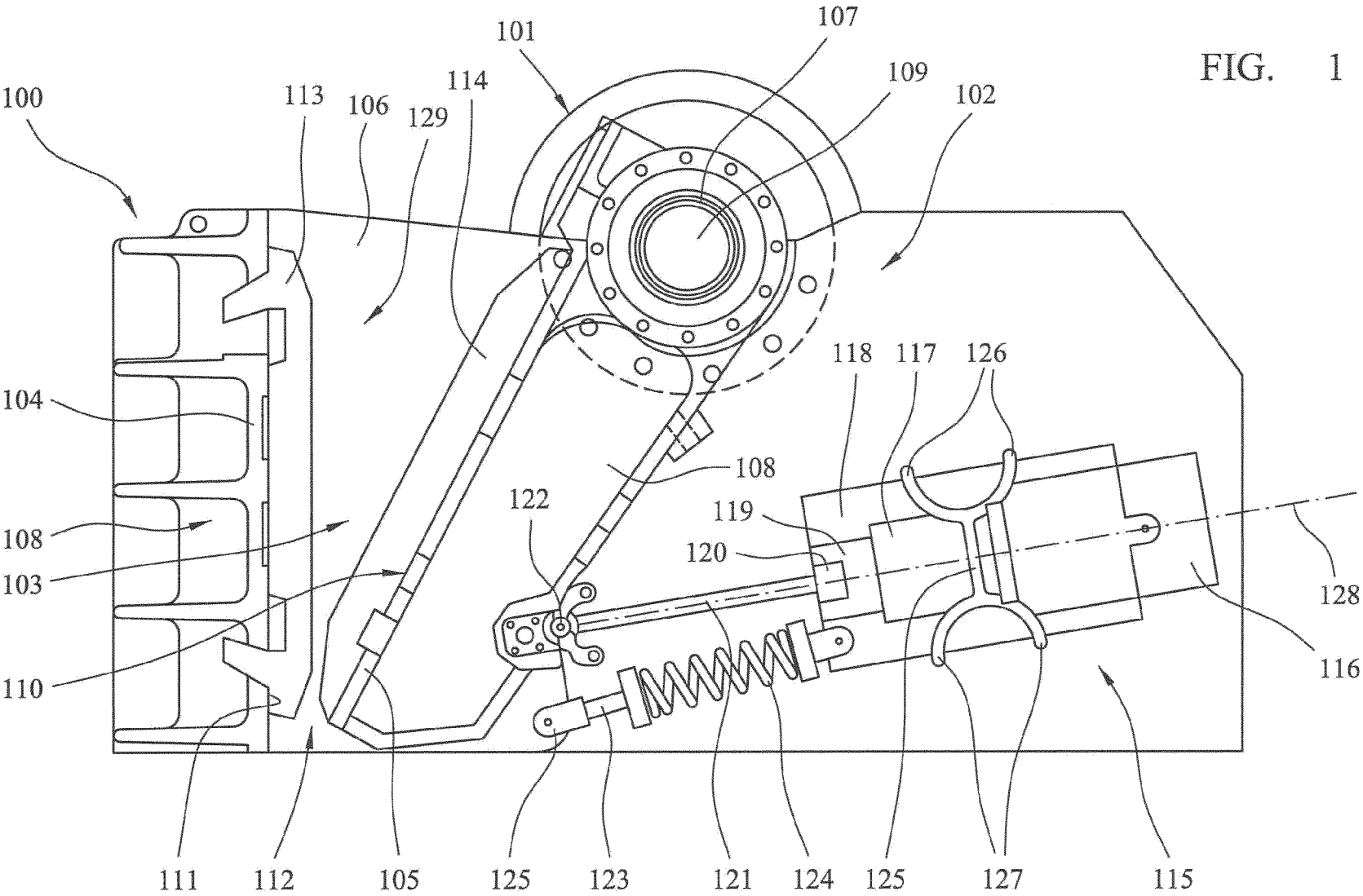
FIG. 1 is cross-sectional side elevation view of a jaw crusher in which a movable jaw is positioned in opposed relationship to a stationary jaw and is positionally supported by a back frame end via a mechanically actuated linkage assembly according to a specific implementation of the present invention.

Referring to FIG. 1, a jaw crusher unit 100 comprises a main frame 102 upon which is mounted a movable jaw 105 and a substantially planar fixed jaw 104. The substantially planar movable jaw 105 is mounted eccentrically at a rotatable shaft 107 (extending from underneath an end cap 109) and is positioned separated and opposed to fixed jaw 104. The orientation of fixed jaw 104 and movable jaw 105 relative to one another is convergent along their respective lengths such that a separation distance between a crushing face 111 of fixed jaw 104 and a corresponding crushing face 110 of movable jaw 105 decreases in the downward lengthwise direction. A suitable wear plate 113 is removably attached to crushing face 111 of fixed jaw 104 and a corresponding wear plate 114 is removably attached to crushing face 110 of movable jaw 105. Main frame 102 comprises two opposed frame walls that support the front frame end 108, which are aligned substantially perpendicular to frame walls 102. The side frame walls 102 extends either side of fixed jaw 104 and movable jaw 105 and collectively define a crushing zone 103.

The opposed fixed and movable jaws 104, 105 are oriented to be inclined relative to one another and are spaced further apart at their respective upper end than their lower end. Accordingly, the crushing zone 103 is convergent from an upper feed region 129 to a lower discharge region 112.

A pair of pulley wheels 101 are mounted either end of shaft 107 at an external facing side of side frame walls 102 being external to the crushing zone 103. Movable jaw 105 is thereby configured for gyroscopic or eccentric motion with respect of fixed jaw 104 as pulley wheels 101 and shaft 107 are rotated via a suitable drive belt (not shown) attached to a drive motor (not shown). This movement of jaw 105 provides the necessary crushing action for material within zone 103 between the opposed wear plates 113 and 114.

Material to be crushed is introduced into zone 103 via the open upper region 129 where it is crushed between jaws 104, 105 and subsequently discharged via the open lower region 112. A plurality of removably mounted side liners 106 are attached to each side frame wall 102 at the region of crushing zone 103 via a plurality of anchorage bolts.

The movable jaw 105 is supported by back frame end 115. In particular, a support frame 118 mounts a mechanically actuated link assembly that is coupled to a lower region of movable jaw 105 so as to support and stabilise the oscillating movement of jaw 105 and control the separation distance between the opposed wear plates 113, 114. The link assembly comprises a collapsible link member, in the form of a substantially planar toggle plate 121 coupled at one side to the movable jaw 105 via a seating bush 122. A second side of toggle plate 121 is secured at a second seating bush 120 mounted within a guide block assembly 119. A piston 117 is aligned coaxially with and abuts against guide block 119. A mechanical actuator 116, in the form of a hydraulic thrust-bearing cylinder is coupled with piston 117 to provide a hydraulic ram assembly to absorb and transmit the loading forces imparted for the back frame end 115 by movable jaw 105. The link assembly 121, 119, 117, 116 are aligned substantially coaxially about longitudinal axis 128. A tension rod 123 is mounted at a lower portion 125 of jaw 105 and comprises a compression spring 124 extending between the jaw 105 and back frame end 115.

Frame 118 comprises a force transmission wall 125 aligned substantially perpendicular to the axis 128 of the link assembly. Wall 125 is reinforced at its respective upper and lower ends (when oriented in normal use) by a respective upper first reinforcement region 126 and a lower second reinforcement region 127. Reinforcements 126, 127 also extend perpendicular to axis 128 and comprise portions that project forward and rearward of wall 125 relative to its orientation with respect to movable jaw 105.

Toggle plate 121 acts as a collapsible connecting member that connects the rear support frame 118 to the movable jaw 105 such that jaw 105 is retained in floating manner with respect to main frame 102 and stationary jaw 104 to allow movable jaw 105 to freely oscillate by the reciprocating motion induced by shaft 107.

Mechanical actuator 116 is formed as a hydraulic thrust-bearing cylinder and is mounted at frame 118. The cylinder 116 acts upon the movable piston 117 which is capable of sliding movement through frame 118 to act, in turn, upon toggle plate 121. According to a second mode of operation, cylinder 116 may be isolated by inserting 'shims' (not shown) at the region of force transmission wall 125. With the shims inserted in position via separate mechanical actuators (not shown), the force transmission pathway passes through plate 121, guide block 119 through shims (not shown) and on to wall 125. In this second mode, the crusher is enabled for appreciably greater capacity to crush harder materials with regard to the first mode with the cylinder engaged.

The longitudinal axis 128 of the link assembly is inclined relative to a substantially horizontal plane extending through a mid-region of the crusher 100. Accordingly, frame 118, cylinder 116, piston rod 117, guide block 119 and toggle plate 121 are generally inclined in a downward angle relative to the horizontal plane.

Figure 2:
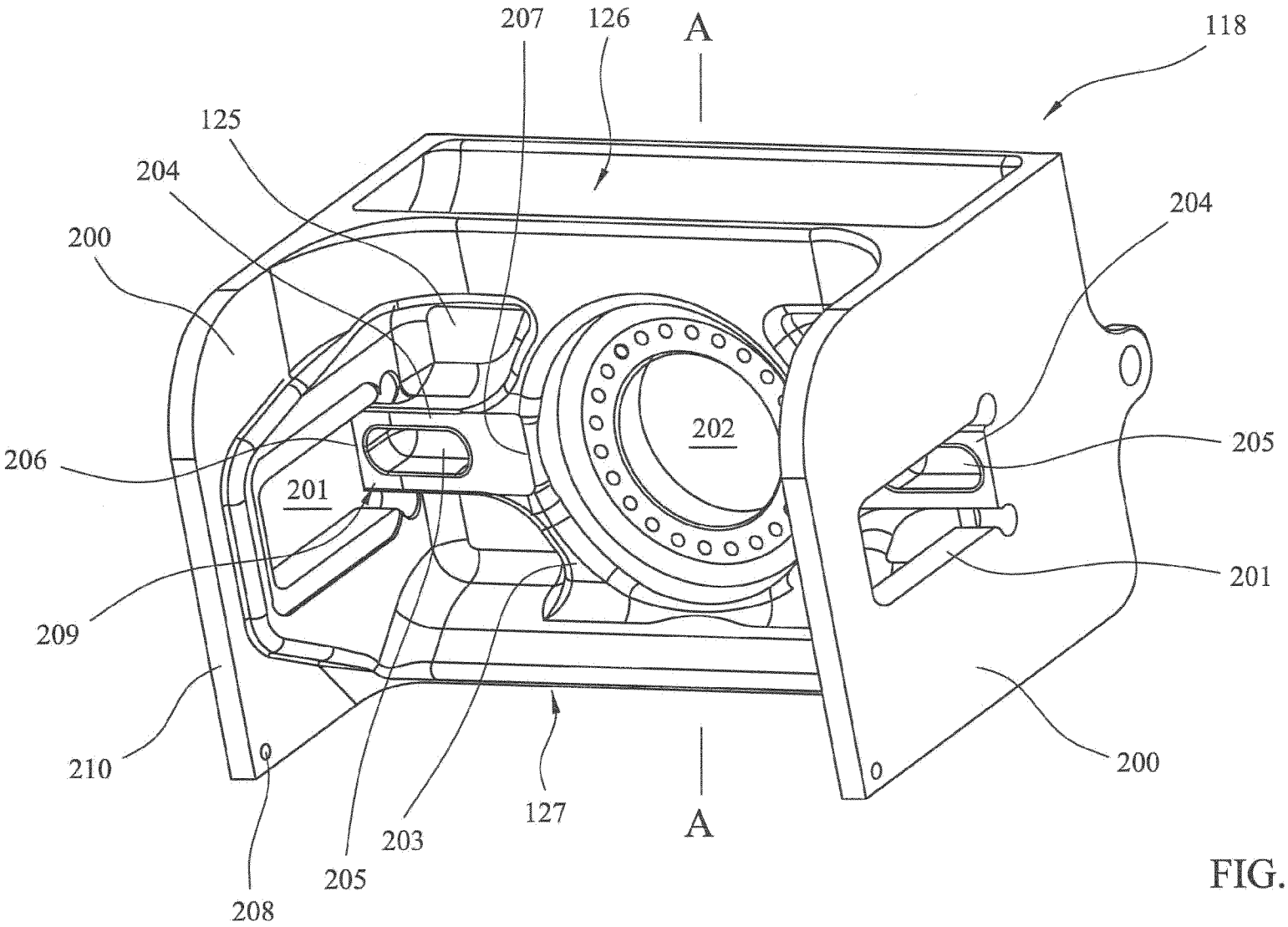
FIG. 2 is a perspective view of the back frame end of FIG. 1 according to a specific implementation of the present invention.
Figure 3:
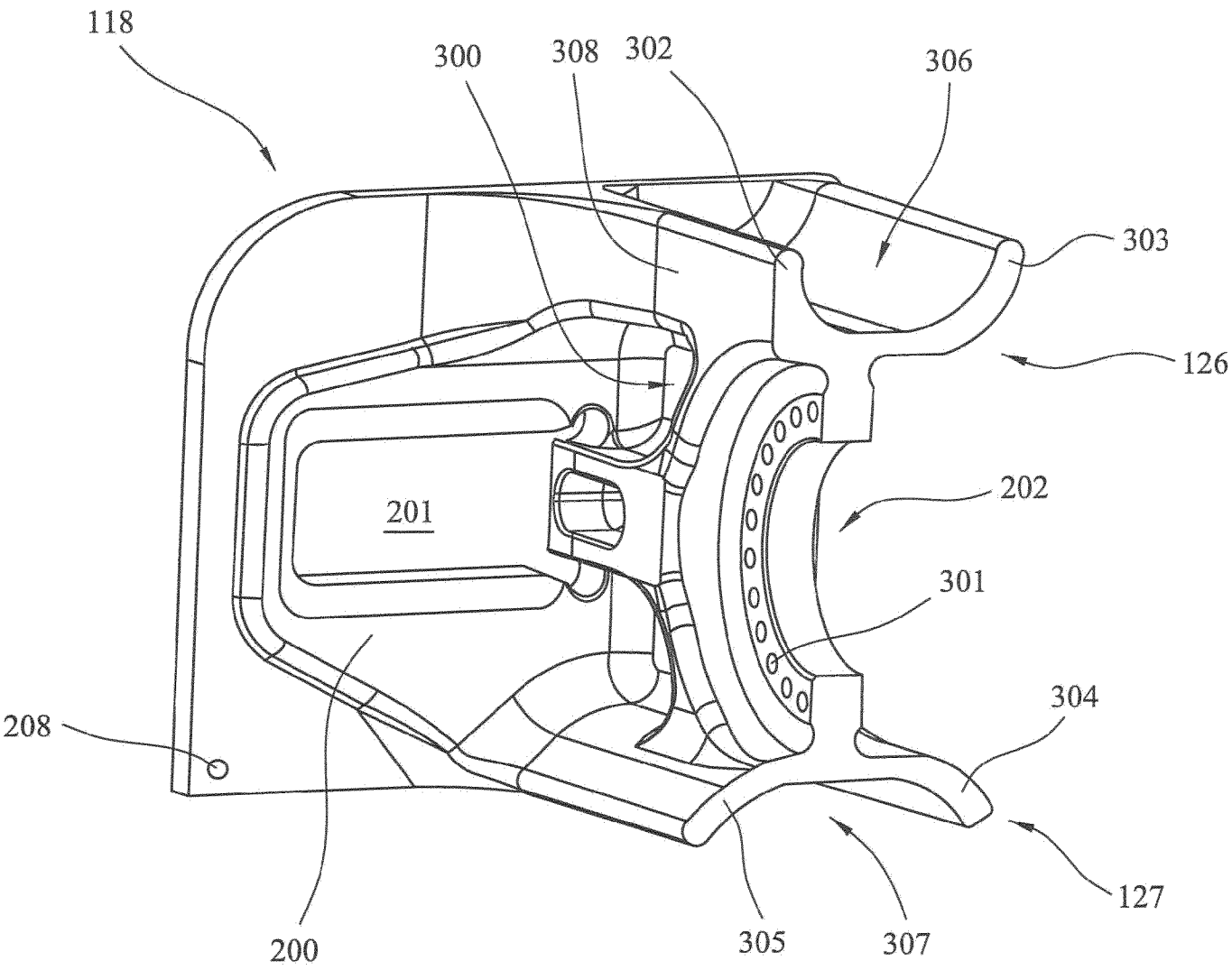
FIG. 3 is a perspective cross-section view through A-A of FIG. 1.
Figure 4:
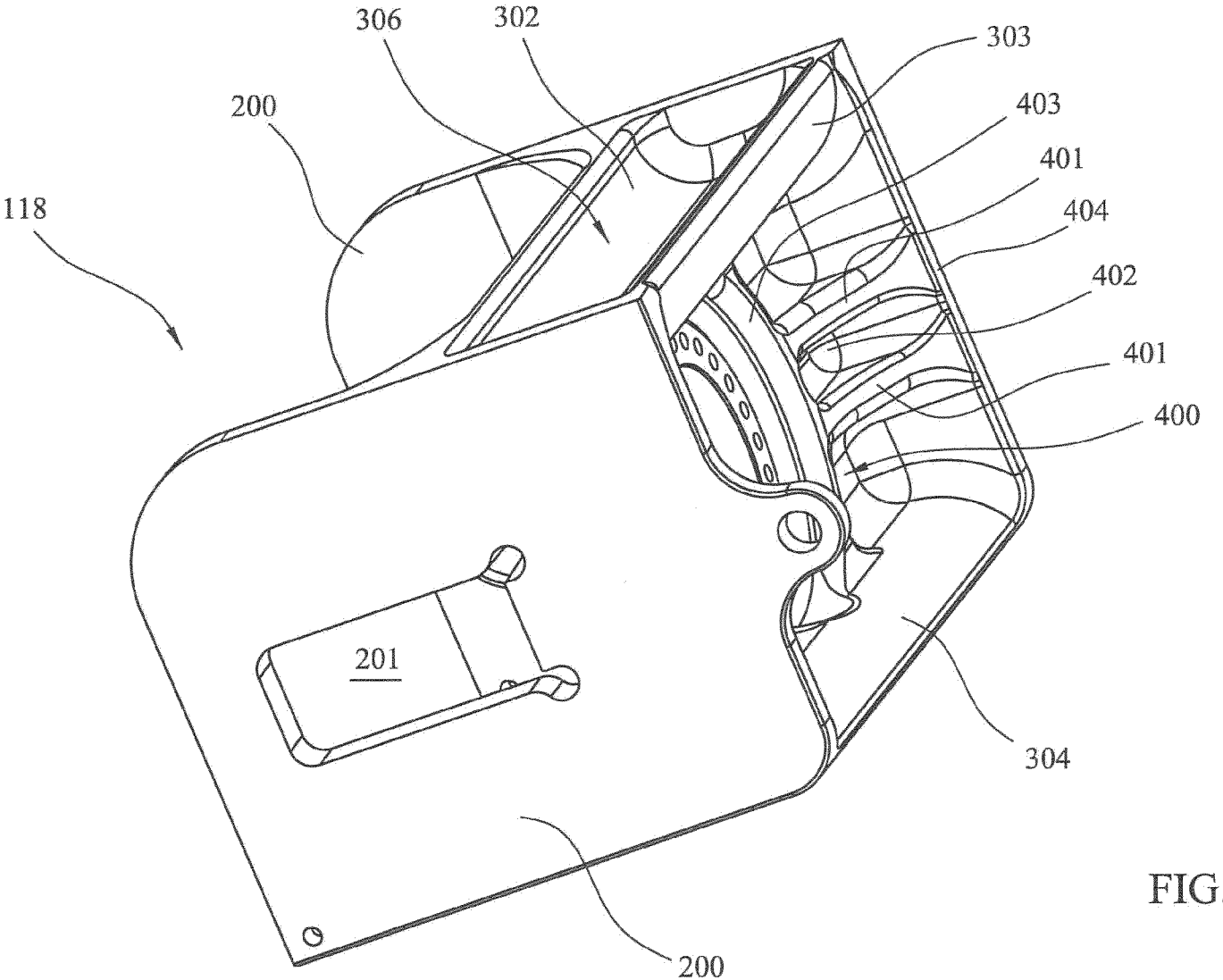
FIG. 4 is a rear perspective view of the back frame end of FIG. 2.

Referring to FIGS. 2 to 4, Support frame 118 principally comprises force transmission wall 125 that is generally planar having a length and a width. The thickness of wall 125 is variable and different regions along its length and width comprise relative thicker regions representing reinforcement sections. A pair of side walls 200 are aligned perpendicular to transmission wall 125 and are connected to wall 125 along its widthwise edges. Side walls 200 project forwardly from a first face 300 of transmission wall 125. A corresponding smaller portion of side walls 200 also project rearwardly from a second face 400 of transmission wall 125. In normal use, first face 300 is orientated to be facing movable jaw 105 with second face 400 orientated to be facing away from jaw 105.

The first and second lengthwise extending reinforcement regions 126, 127 each comprise a pair of flanges 302, 303 and 304, 305. Each respective pair of flanges or reinforcement regions 126, 127 effectively form double-walled extensions of transmission wall 125 that extend the full length of wall 125 at its respective upper and lower length edges. In particular, first flanges 302, 305 of respective reinforcements 126, 127 project forward of first face 300 whilst second flanges 303, 304 of respective reinforcements 126, 127 project rearward from second face 400. As detailed in FIG. 3, each flange 302, 303, 304, 305 is curved along its length with the orientation of the respective curves defining gulleys or channels 306, 307 projecting lengthwise along the upper and lower ends of transmission wall 125. The upper and lower double-walled reinforcement regions 126, 127 significantly increase the load bearing capacity of transmission wall 125 so as to optimise the strength and size of frame 118. This optimisation is also facilitated by further reinforcement regions identified below.

According to the specific embodiment, a curvature of each respective flange 302, 303, 304, 305 is not identical. In particular, flange 302 comprises a smaller radius of curvature than flanges 303, 304, 305. In particular, an end region of flange 302 is orientated to define a substantially planar face 308 aligned parallel with first face 300 and displaced forward of face 300. As detailed in FIG. 3, a cross-section of transmission wall 125 through A-A comprises a generally 'I' configuration with the upper and lower end portions of the 'I' being bent effectively upward and downward to define respective upward and downward facing cup-end sections separated by a straight wall section.

A circular aperture 202 extends through transmission wall 125. Aperture 202 is bordered circumferentially by a plurality of bore holes 301 that also extend through transmission wall 125 between first and second faces 300, 400. Aperture 202 is further reinforced by a reinforcing collar 203 that extends circumferentially around bore holes 301. A thickness of collar 203 is substantially equal to a distance by which surface 308 extends forward from surface 300. However, flange 305 at its forwardmost end, projects beyond collar 203 in the longitudinal direction 128 towards jaw 105. Aperture 202 is positioned substantially centrally through transmission wall 125 relative to the lengthwise and widthwise edges and comprises an internal diameter being only slightly greater than an external diameter of piston rod 117. Accordingly, piston 117 is capable of reciprocating sliding motion through aperture 212. As detailed in FIG. 1, piston 117 extends forward from first face 300 whilst cylinder 116 extends rearward from second face 400. Transmission wall 125 is positioned at the junction between piston 117 and cylinder 116.

Wall 125 is further reinforced at a mid-widthwise region by a pair of shim projections 204 that extend lengthwise parallel to reinforcement end regions 126, 127. Shim projections 204 also extend between each respective side wall 200 and reinforcement collar 203 such that a first end 206 of projection 204 is aligned at side wall 200 and a second end 207 of projection 204 is aligned at collar 203. Accordingly, each shim projection 204 is separated along its length by aperture 202. A distance by which each projection 204 extends from the first face 300 is substantially equal to a distance by which face 308 and collar 203 extend from first face 300. Each projection 204 comprises a generally rectangular forward facing surface 209 aligned parallel to face 300. A recessed cavity 205 projects rearwardly from face 209 within each shim projection 204. A depth of cavity 205 can be less than the distance by which shim projection 204 extends from first face 300.

Wall 125 is further reinforced at the opposed rear facing side 300 of shim projections 204. In particular, a pair of reinforcement ribs 401 project rearwardly from rear face 400 and extend radially out from collar 203 and terminate at a rearmost edge 404 of each side wall 200. As collar 403 at the rearward facing side, projects from rear face 400 by a distance less than a distance by which side walls 200 extend from rear face 400, the reinforcement ribs 401 taper outwardly in the longitudinal direction 128 from the rearward reinforced collar 403 to wall edge 404. A recessed cavity 402 is created between the pair of parallel ribs 401 and extends between collar 403 and each side wall 200.

As detailed in FIG. 4, the rearward projecting flanges 303, 304 project from rear face 400 by a distance approximately equal to the distance by which side walls 200 extend from rear face 400. In contrast, and referring to FIGS. 2 and 3, the forward facing flanges 302, 305 project forward from first surface 300 by a distance much less than that by which side walls 200 project from face 300.

Each side wall 200 comprises a substantially rectangular aperture 201 formed in their respective forward projecting portions. Each aperture 201 is positioned approximately midway between a forwardmost edge 210 of each wall 200 and first surface 300. Each shim projection 204 is positioned to border a rearmost width edge of each rectangular aperture 201 in the longitudinal direction 128. Apertures 201 are configured to receive the mechanical shims (not shown) that when inserted through apertures 201 seat against forward facing abutment surfaces 209. Accordingly, shim projections 204 serve as force transmission regions to absorb and transmit loading forces imparted to frame 118 from jaw 105 according to the second 'shim' mode of operation of crusher 100. In this shim mode, the loading force is transmitted to wall 125 where it is divided by upper and lower reinforcement regions 126, 127 with further force transmission division through respective flanges 302, 303, 304, 305. The force is then transmitted through side walls 200. In the first mode of operation, with the thrust-bearing cylinder 116, 117 engaged, the force is transmitted through piston rod 117 into cylinder 116, back through collar 203 (via anchorage bolts positioned through bore holes 301), for subsequent division through wall 125 and side walls 200 according to the 'shim' mode of operation as described.

A pair of mounting apertures 208 extend through respective lower and forwardmost corners of each side wall 200 to provide mounting locations for cross-bars or struts to support further components of the back frame end assembly and/or mount and secure end frame 118 to main frame 102.

The invention claimed is:

1. A jaw crusher support frame to support a movable jaw of a jaw crusher via a mechanically actuated link assembly connected to the movable jaw, at least a part of the link assembly configured to allow the movable jaw to oscillate relative to a substantially stationary jaw in order to crush material in a zone between the movable and stationary jaws, the support frame comprising:

a force transmission wall extending generally in a plane transverse or perpendicular to a longitudinal axis of the link assembly, the force transmission wall having a first side facing the movable jaw and a second side to be rear facing away from the movable jaw;

a piston aperture in the force transmission wall to allow a piston to extend from the first side-of the force transmission wall, the piston being connected to a mechanical actuator positioned at a region of the second side of the force transmission wall; and first and second reinforcement end regions extending along respective first and second lengthwise ends of the force transmission wall, each end region having a first and a second flange, the first flange projecting forward from the first side of the force transmission wall to extend towards the movable jaw and the second flange projecting from the second side of the force transmission wall to extend away from the movable jaw, wherein the first and second flanges are curved relative to a plane of the force transmission wall such that the first and the second flanges curve back towards the plane of the force transmission wall.

2. The support frame as claimed in claim 1, wherein the first and the second flanges each define a respective recessed gully extending lengthwise along the force transmission wall at each lengthwise end.

3. The support frame as claimed in claim 1, wherein a radius of curvature of one of the first flanges at one lengthwise end of the force transmission wall is less than a radius of curvature of the second flange at said lengthwise end.

4. The support frame as claimed in claim 3, wherein an end region of the first flange is aligned substantially parallel to the force transmission wall and projects forward of the first side of the force transmission wall.

5. The support frame as claimed in claim 1, further comprising side walls extending substantially perpendicular to the force transmission wall, the side walls projecting from widthwise edges of the force transmission wall in a direction from the first side of the force transmission wall.

6. The support frame as claimed in any claim 1, wherein a region around the piston aperture includes a reinforcement collar projecting from the first side of the force transmission wall to reinforce the region around the piston aperture against loading forces imparted to the force transmission wall.

7. The support frame as claimed in claim 4, wherein the end region of the first flange projects forward of the force transmission wall by a substantially equal distance by which the reinforcement collar projects from the first side of the force transmission wall.

8. The support frame as claimed in claim 5, wherein each side wall includes an aperture.

9. The support frame as claimed in claim 1, further comprising at least one shim projection extending from the first side of the force transmission wall.

10. The support frame as claimed in claim 9, further comprising two shim projections positioned substantially at a mid-region of the force transmission wall between the first and second reinforcement ends.

11. The support frame as claimed in claim 10, wherein each of the two shim projections are positioned at a respective side of the piston aperture between the piston aperture and each respective side wall.

12. The support frame as claimed in claim 11, wherein the shim projections further extend from the second side of the force transmission wall.

13. The support frame as claimed in claim 5, wherein the side walls also project from the second side of the force transmission wall.

14. A jaw crusher comprising:

a movable jaw and a substantially stationary jaw mounted in opposed relationship to define a crushing zone between the jaws;

a drive mechanism coupled with the movable jaw and operative to oscillate the movable jaw relative to the stationary jaw in order to crush material in the crushing zone;

a mechanical actuator link assembly connected to the movable jaw and configured to control movement of the movable jaw relative to the stationary jaw; and a support frame supporting the movable jaw via the link assembly, the support frame including a force transmission wall extending generally in a plane transverse or perpendicular to a longitudinal axis of the link assembly, the force transmission wall having a first side facing the movable jaw and a second side to be rear facing away from the movable jaw, a piston aperture in the force transmission wall to allow a piston to extend from the first side-of the force transmission wall, the piston being connected to a mechanical actuator positioned at a region of the second side of the force transmission wall, and first and second reinforcement end regions extending along respective first and second lengthwise ends of the force transmission wall, each end region having a first and a second flange, the first flange projecting forward from the first side of the force transmission wall to extend towards the movable jaw and the second flange projecting from the second side of the force transmission wall to extend away from the movable jaw, wherein the first and second flanges are curved relative to a plane of the force transmission wall such that the first and the second flanges curve back towards the plane of the force transmission wall.

* * * * *